US008245416B2

(12) United States Patent
Polegato Moretti

(10) Patent No.: US 8,245,416 B2
(45) Date of Patent: Aug. 21, 2012

(54) WATERPROOF VAPOR-PERMEABLE SHOE

(75) Inventor: Mario Polegato Moretti, Crocetta del Montello (IT)

(73) Assignee: GEOX S.p.A., Montebelluna (IT)

( * ) Notice: Subject to any disclaimer, the term of this patent is extended or adjusted under 35 U.S.C. 154(b) by 1049 days.

(21) Appl. No.: 11/996,811

(22) PCT Filed: Jul. 17, 2006

(86) PCT No.: PCT/EP2006/006989
§ 371 (c)(1),
(2), (4) Date: Jan. 25, 2008

(87) PCT Pub. No.: WO2007/012415
PCT Pub. Date: Feb. 1, 2007

(65) Prior Publication Data

US 2008/0216358 A1 Sep. 11, 2008

(30) Foreign Application Priority Data

Jul. 26, 2005 (IT) ..... PD2005A0228

(51) Int. Cl.
*A43B 13/28* (2006.01)
*A43B 7/08* (2006.01)
*A43B 23/07* (2006.01)

(52) U.S. Cl. ..... 36/14; 36/3 B; 36/55; 36/12

(58) Field of Classification Search ..... 36/14, 3 B, 36/55, 30 R, 12
See application file for complete search history.

(56) References Cited

U.S. PATENT DOCUMENTS 5,285,546 A * 2/1994 Haimerl ..... 12/142 E
5,689,903 A * 11/1997 Aumann ..... 36/77 R
5,711,093 A * 1/1998 Aumann ..... 36/77 R
5,737,857 A * 4/1998 Aumann ..... 36/77 R
6,389,711 B1 * 5/2002 Polegato ..... 36/3 R
6,408,541 B1 * 6/2002 Moretti ..... 36/12
6,604,302 B2 * 8/2003 Polegato Moretti ..... 36/55
2005/0050769 A1 3/2005 Haimerl et al.

FOREIGN PATENT DOCUMENTS

DE 40 07 962 9/1990
WO 2005 063069 7/2005
WO 2005 070658 8/2005

OTHER PUBLICATIONS

U.S. Appl. No. 13/091,355, filed Apr. 21, 2011, Polegato Moretti, et al.

* cited by examiner

*Primary Examiner* — Ted Kavanaugh
(74) *Attorney, Agent, or Firm* — Oblon, Spivak, McClelland, Maier & Neustadt, L.L.P.

(57) ABSTRACT

A waterproof and water vapor-permeable shoe, including a bottom shoe part with a sole perforated through from the tread toward a foot resting region, a top part surrounding the foot and including a vapor-permeable or perforated lining, a waterproof and vapor-permeable membrane surrounding the foot, and a vapor-permeable or perforated upper. The outer bottom portion of the top shoe part, which is superimposed on the perforated area of the sole, is constituted by a portion of the membrane. A vapor-permeable or perforated protective element for the portion of the membrane is provided below the portion of the membrane and above the tread of the sole. A water sealing region provided between the portion of the membrane and the sole, around the perforated area of the sole, separates flaps of the upper from the perforated area of the sole.

11 Claims, 5 Drawing Sheets

WATERPROOF VAPOR-PERMEABLE SHOE

TECHNICAL FIELD

The present invention relates to a waterproof shoe permeable to water vapor.

BACKGROUND ART

It is now well-known that the comfort of a shoe is linked not only to correct anatomical contouring of the fit but also to correct outward permeation of the water vapor that forms within the shoe due to perspiration.

Traditionally, vapor-permeable shoes are those which use natural materials such as leather or equivalent products, which however, in the presence of rain or bad weather, indeed because of their vapor-permeable properties, do not ensure good waterproofing and indeed rather easily absorb water.

For this reason, shoes with an upper made of leather (or the like) coupled to a lining with a vapor-permeable and waterproof membrane (made for example of a material such as Gore-Tex® or the like), sewn or glued to an insole, have now been used for some years.

In the manufacture of such shoes it is important to pay attention to the sealing of the regions connecting the insole and the lining to the membrane and the sole, in order to prevent even the smallest infiltration of water from outside.

However, as is known, most of the perspiration of the foot is generated at the interface between the sole of the foot and the sole of the shoe, which is typically made of polymeric material.

It is evident that the perspiration that forms on this interface is unable to evaporate, condensing therefore on the plantar insert on which the foot rests; only a minor percentage of the perspiration evaporates through the upper.

For this reason, shoes have now been devised for years which are provided with vapor-permeable and waterproof soles (such as for example the one disclosed in EP0858270) which are associated with waterproof and vapor-permeable uppers, such as the ones described above, in order to provide shoes which are completely waterproof and vapor-permeable.

The shoe disclosed in EP0858270 in practice has a sole which is constituted by two layers with through holes and with the interposition of a membrane which is waterproof and vapor-permeable (made for example of a material such as Gore-Tex® or the like), which is joined perimetrically and hermetically to the two layers, so as to prevent water infiltrations.

This sole ensures correct vapor permeation as well as an effective exchange of heat and water vapor between the environment inside the shoe and the outside environment, at the same time ensuring the necessary impermeableness with respect to external humidity and water, in a manner similar to what is provided by the upper with which the membrane is associated.

In this shoe configuration, the sole and the upper are two separate parts, both of which are vapor-permeable and waterproof and are associated and sealed together so as to prevent the rise of water in the connecting points.

The soles used in such shoes are therefore structured so as to allow vapor permeation but not the flow of water from the outside inwardly; the structure of the sole is therefore more complicated than a traditional sole, and this complexity arises from the accommodation of the membrane and from the correct parametric seal thereof with the sole.

The same Applicant is studying completely waterproof shoes in which the vapor-permeable and waterproof membrane related to the vapor permeation of the sole of the foot is provided substantially monolithically with the membrane associated with the upper.

The idea is to provide a shoe composed of a lower part, which comprises a sole provided with through perforations from the tread toward the foot supporting region, and an upper pouch-like part, which surrounds the foot completely and is constituted by an internal pouch-like lining, with which a vapor-permeable and waterproof membrane is associated as an outer layer thereof and with which an outer vapor-permeable upper, closed in a downward region by an assembly insole sewn or glued to the upper, is laterally associated.

The sole is sewn or glued to the upper and to the assembly insole preferably with the interposition of a protective layer for the membrane.

This type of shoe construction, however, suffers drawbacks, due mainly to the fact that the water that rises from the holes of the tread and flows toward the inside of the shoe reaches the protective layer and the insole.

In particular, the insole becomes wet and transfers humidity also to the peripheral part of the upper to which it is fixed; such shoe parts, therefore, remain wet, and although the membrane prevents the water from entering the shoe, the foot receives an unpleasant feeling of damp cold.

Moreover, the parts impregnated with water in the long term may form colonies of molds, fungi and bacteria, which can produce unpleasant smells, leading to a general deterioration of the shoe.

DISCLOSURE OF THE INVENTION

The aim of the present invention is to provide a waterproof shoe permeable to water vapor that ensures complete waterproofing both on the top part related to the upper and on the bottom part related to the sole.

Within this aim, an object of the present invention is to provide a shoe that is completely waterproof and vapor-permeable and does not have regions that retain water if wet.

Another object of the present invention is to provide a shoe that is completely waterproof and vapor-permeable and is structurally simple to obtain.

Another object of the present invention is to provide a shoe completely waterproof and vapor-permeable that is strong and durable.

Still another object of the present invention is to provide a shoe completely waterproof and vapor-permeable that can be manufactured with known systems and technologies.

This aim and these and other objects, which will become better apparent hereinafter, are achieved by a waterproof vapor-permeable shoe according to the invention, characterized in that it comprises:

- a bottom shoe part, which comprises a sole that is perforated through from the tread toward the foot resting region,
- a top part, which surrounds the foot completely and in turn comprises, from the inside outwardly:
  - a vapor-permeable or perforated lining,
  - a membrane, which is waterproof and vapor-permeable and surrounds the foot completely,
  - a vapor-permeable or perforated upper,
- the outer bottom portion of said top shoe part, which is superimposed on the perforated area of said sole, being constituted by a portion of said membrane,
- a vapor-permeable or perforated protective element for said membrane portion being provided below said membrane portion and above the tread of said sole, the material arranged below said membrane portion and in direct contact therewith being waterproof and/or not retaining liquids, a water sealing region being provided between said membrane portion and said sole, around the perforated area of said sole, and separating the flaps of said upper from the perforated area of said sole.

BRIEF DESCRIPTION OF THE DRAWINGS

Further characteristics and advantages of the invention will become better apparent from the description of some preferred but not exclusive embodiments thereof, illustrated by way of non-limiting example in the accompanying drawings, wherein.

WAYS OF CARRYING OUT THE INVENTION

In the exemplary embodiments that follow, individual characteristics, given in relation to specific embodiments may actually be interchanged with other different characteristics that exist in other exemplary embodiments.

Moreover, it is noted that anything found to be already known during the patenting process is understood not to be claimed and to be the subject of a disclaimer.

Figure 1:
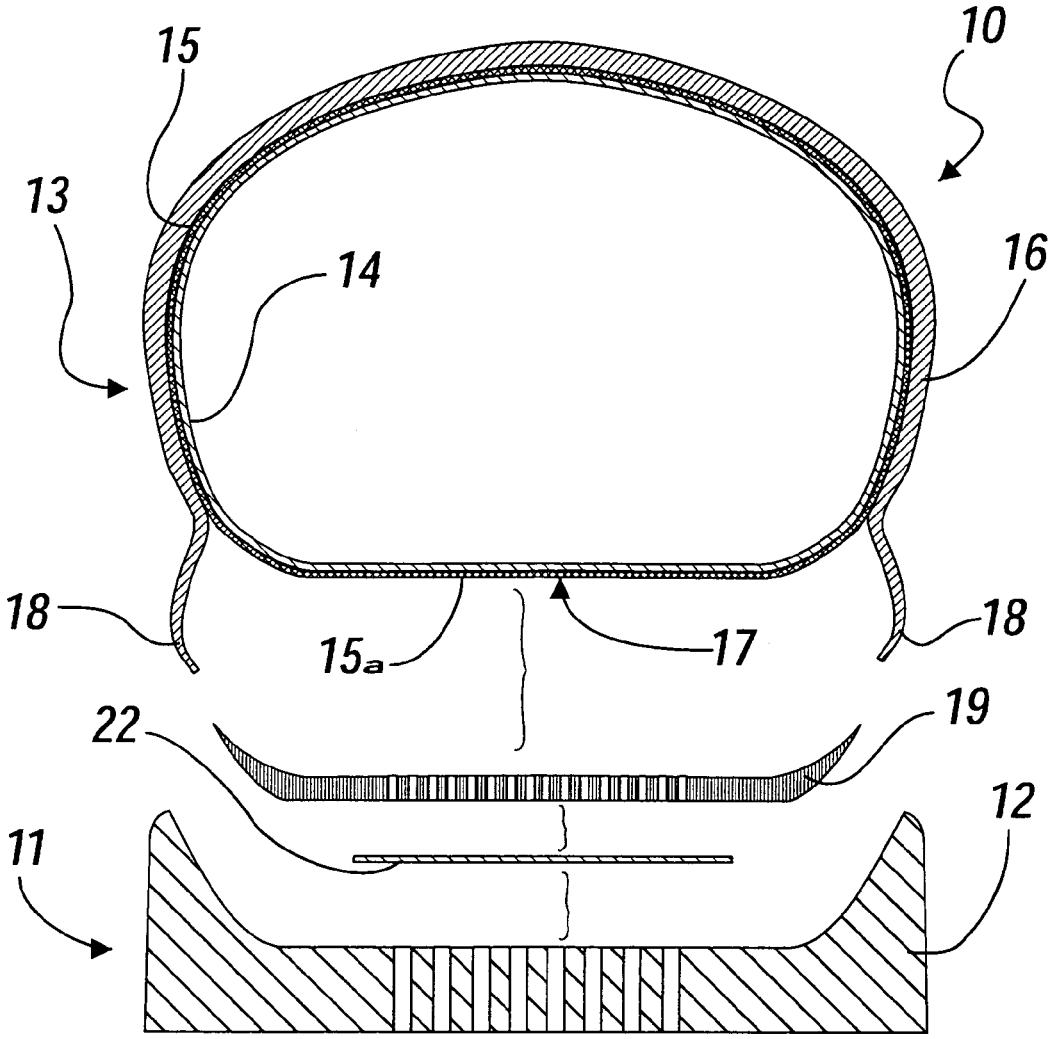
FIG. 1 is a schematic transverse sectional view of a first embodiment of a shoe according to the invention, shown separated into its bottom, top and intermediate parts.
Figure 2:
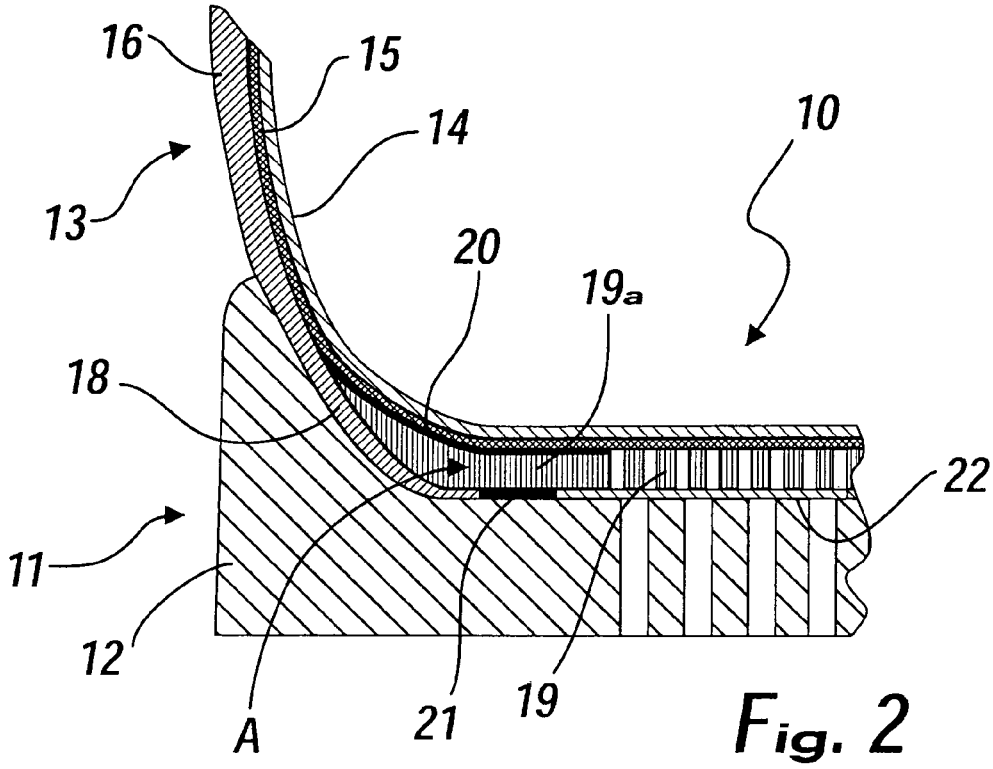
FIG. 2 is an enlarged-scale view of a portion of the shoe of FIG. 1.

With reference to FIGS. 1 and 2, a first embodiment of a shoe according to the invention is generally designated by the reference numeral 10.

The shoe 10 comprises a bottom part 11, which is constituted by a sole 12, which is perforated through from the tread toward the foot resting region, and a top part 13, which surrounds the foot and in turn comprises, from the inside outwardly, a lining 14, which surrounds the foot completely, a waterproof and vapor-permeable membrane 15, such as for example of the type known commercially by the trade name Gore-Tex® (optionally associated with a supporting mesh, not shown in the figures, according to a per se known structure), and an upper 16, made for example of leather, in any case of the vapor-permeable or perforated type, which surrounds the foot laterally.

The membrane 15 is associated with the lining 14 as an outer layer thereof substantially along the entire pouch-like extension and therefore also along the part related to the sole of the foot.

An outer bottom portion 17 of the top part 13 of the shoe 10, which is superimposed on the perforated area of the sole 12, is constituted by a portion 15*a* of the membrane 15.

In practice, the upper 16 surrounds the lining 14 laterally with the membrane 15 but does not cover it in its lower part.

Lower flaps 18 of the upper 16 are arranged between the top part 13 and the sole 12, as described in greater detail hereinafter.

A perforated or equivalently vapor-permeable assembly insole 19 is interposed, in direct contact with a portion 15*a* of the membrane 15, between the outer bottom portion 17 of the top part 13 of the shoe 10 (in practice the portion of the membrane 15 arranged at the sole of the foot) and the sole 12.

Conveniently, the assembly insole 19 is sealed perimetrically directly onto the membrane 15; the corresponding sealing area is termed first sealing area (shown in the figure with a dark line) and is designated by the reference numeral 20.

Advantageously, the assembly insole 19 is made of a material that is waterproof and does not retain liquids, such as a polymeric material, for example EVA (ethyl vinyl acetate) or low-density PU (polyurethane).

The first area 20 for sealing the insole 19 to the membrane 15 is adapted to prevent any passage of water from the region of the insole 19 to the region of the lower flaps 18 of the upper 16 that adhere to the membrane 15 proximate to the edge of the insole 19 and vice versa.

The lower flaps 18 of the upper 16 are superimposed and fitted on a parametric portion 19*a* of the assembly insole 19.

Below the assembly insole 19, at the perforated area of the sole 12, there is a protective element 22 for the membrane 15, which is vapor-permeable (or equivalently perforated) and is constituted for example by a net made of metal (for example stainless steel) or made of plastic material or synthetic resin based on propylene or polyethylene, or a synthetic fabric; preferably, the protective element 22 must not allow the stagnation of water.

The lower flaps 18 of the upper 16 are reduced in thickness in order to allow the joining of the insole 19 to the sole 12 without particular increases in thickness.

If a thicker protective element is to be used, in a constructive variation, not shown in the figures, it is possible to provide on the upper surface of the sole a recess which is open upwardly, is complementary with respect to said protective element and is of suitable depth.

A second sealing area 21 (shown in the figure by means of a dark line) is provided, between the lower flaps 18 of the upper 16 and the protective element 22, for sealing the sole 12 to the parametric portion 19*a* of the assembly insole 19 that is free from the flaps 18 of the upper 16.

The first sealing area 20, together with the second sealing area 21 and the parametric portion 19*a* of the insole 19 that is arranged between them, forms a water sealing region A, which prevents the passage of water from the perforated region of the sole 12 to the flaps 18 of the upper 16 and vice versa, and also prevents the stagnation of water in said sealing region A.

In practice, the water can rise from the holes of the sole 12, pass through the protective element 22, pass through the insole 19 and stop against the portion 15*a* of the waterproof and vapor-permeable membrane 15.

Here, the water cannot stagnate, since the material of the insole does not allow this, and also cannot infiltrate toward the lower flaps 18 of the upper due to the presence of the sealing region A; the water therefore descends again, moving in reverse with respect to the ascending path.

Likewise, if the upper is wet laterally, the water can be absorbed up to the lower flaps 18 of the upper, but from there the moisture can evaporate easily by following the opposite path with respect to absorption.

Therefore, in contact with the membrane 15 there is a layer, the insole 19, which does not remain humid and does not become impregnated with water, thus limiting any formation of molds, fungi or other microorganisms capable of generating bad smells and of generally degrading the shoe; likewise, the part between the perforated area and the flaps of the upper also does not remain wet, since this region corresponds to the water sealing region.

Preferably, any additional layers arranged below the assembly insole 19 also are made of materials that are impermeable to water and do not retain liquids.

Figure 3:
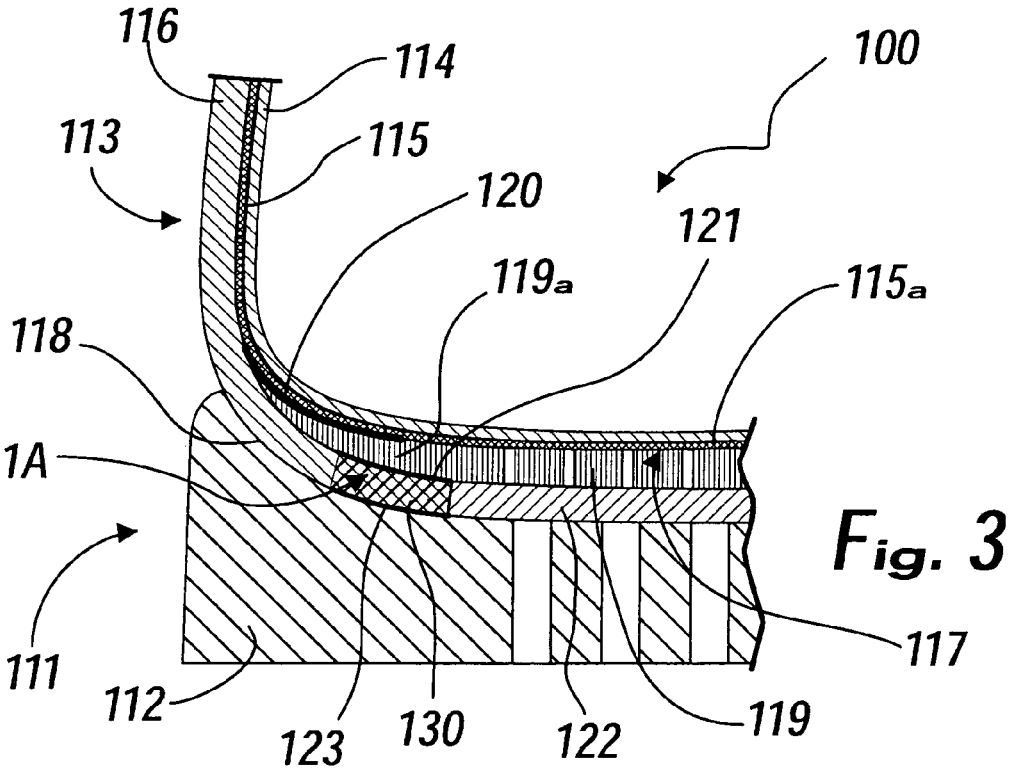
FIG. 3 is a schematic transverse sectional view of a portion of a shoe according to the invention, in a second embodiment with respect to FIGS. 1 and 2.

A second embodiment of the shoe is shown in FIG. 3 and is generally designated by the reference numeral 100; this new embodiment differs from the preceding one substantially in the manner in which the insole, the sole and the upper are joined, as described hereinafter.

The shoe 100 comprises, as in the preceding embodiment, a bottom part 111 constituted by a sole 112, which is perforated through from the tread towards the foot resting region, and by a top part 113, which surrounds the foot and in turn comprises, from the inside outwardly, a lining 114, which surrounds the foot completely, a membrane 115, which is impermeable to water and permeable to water vapor, such as for example of the type known commercially by the name Gore-Tex® (optionally associated with a supporting mesh, not shown in the figures, according to a per se known structure), and an upper 116, made for example of leather and in any case of the vapor-permeable or perforated type, which surrounds the foot laterally.

The membrane 115 is associated with the lining 114 as an outer layer thereof substantially along the entire pouch-like extension and therefore also along the part related to the sole of the foot.

An outer lower portion 117 of the upper part 113 of the shoe 100, which is superimposed on the perforated area of the sole 112, is constituted by a portion 115*a* of the membrane 115.

In practice, the upper 116 surrounds laterally the lining 114 with a membrane 115 but does not cover it in its lower part.

The lower flaps 118 of the upper 116 are arranged between the top part 113 and the sole 112, as described in greater detail hereinafter.

A perforated or equivalently vapor-permeable assembly insole 119 is interposed, in direct contact with a portion 115*a* of the membrane 115, between the outer bottom portion 117 of the top part 113 of the shoe 100 (in practice the portion of the membrane 15 that is arranged at the sole of the foot) and the sole 112.

Conveniently, the assembly insole 119 is sealed perimetrically directly onto the membrane 115; the corresponding sealing area is termed first sealing area and is designated by the reference numeral 120 (shown in dark lines in the figure).

Advantageously, the assembly insole 119 is made of a material that is waterproof and does not retain liquids, such as a polymeric material, for example of the type of EVA (ethyl vinyl acetate) or low-density PU (polyurethane).

The first sealing area 120 for sealing the insole 119 to the membrane 115 is adapted to prevent any passage of water from the region of the insole 119 to the region of the lower flaps 118 of the upper 116 that adhere to the membrane 115 proximate to the edge of the insole 119 and vice versa.

The lower flaps 118 of the upper 116 are superimposed and fitted on a parametric portion 119*a* of the assembly insole 119.

Below the assembly insole 119, at the perforated area of the sole 112, there is a protective element 122 for the membrane 115, which is vapor-permeable (or equivalently perforated) and is constituted for example by a net which is made of metallic material (for example of stainless steel) or made of plastic material or synthetic resin based on propylene or polyethylene or a synthetic fabric; preferably, the protective element 122 must not allow the stagnation of water.

The lower flaps 118 of the upper 116, in this embodiment, do not have a reduced thickness.

For this reason, between the lower flaps 118 of the upper and the protective element 122 there is an annular element 130, which surrounds the perforated area of the sole 112.

The annular element 130 is made for example of a material that is waterproof and does not retain liquids, such as for example a polymeric material such as EVA (ethyl vinyl acetate) or low-density PU (polyurethane), and is useful, as mentioned, when the lower flaps 118 of the upper 116 have such dimensions as to not allow to fix the sole to the insole 119 with a suitable seal and therefore it has both sealing and filling functions.

The annular element 130 is adjacent to the edges of the lower flaps 118 of the upper 116.

The annular element 130 is sealed in an upward region with respect to the insole 119 and in a downward region with respect to the sole 112 by means of, respectively, a second sealing area 121 and a third sealing area 123 (both shown in the figure by means of dark lines).

In this embodiment, the water sealing region, now designated by the reference sign 1A, is formed by the first sealing area 120, by the second sealing area 121, by the parametric insole portion 119*a* arranged between them, and by the annular element 130 with the third sealing area 123.

The remarks made for the first embodiment of the shoe 10 as regards the stagnation of water are substantially the same also as regards this second embodiment 100.

It is evident that, both in this embodiment and in the first described embodiment, the extent of the various sealing areas may be different according to the constructive requirements.

Figure 4:
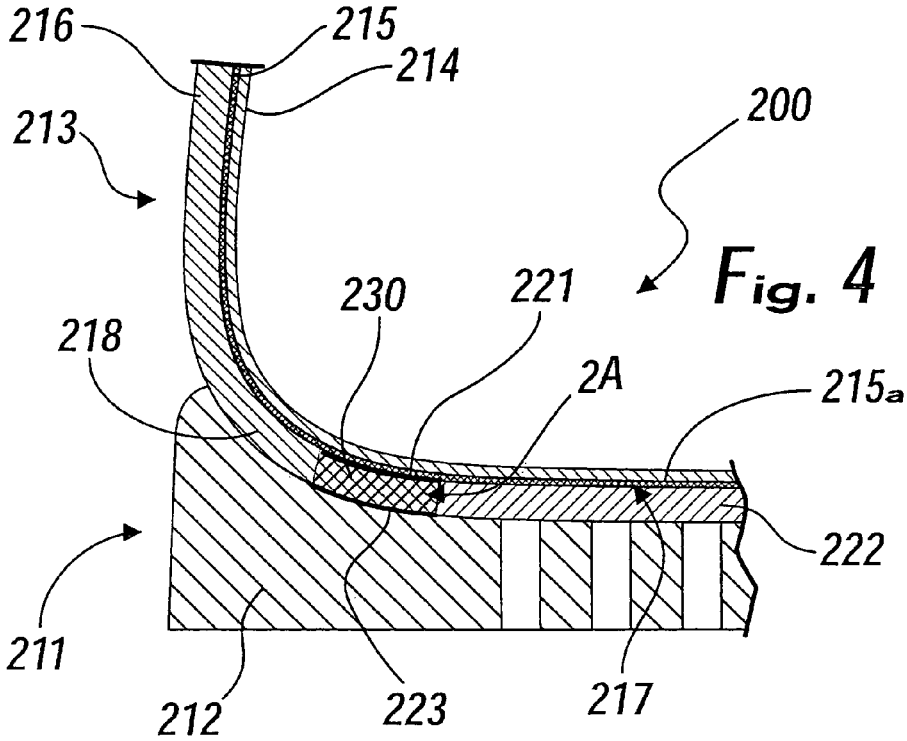
FIG. 4 is a schematic transverse sectional view of a portion of a shoe according to the invention, in a third embodiment with respect to the preceding figures.

A third embodiment of the shoe is shown in FIG. 4 and is generally designated by the reference numeral 200.

The shoe 200 comprises, as in the preceding embodiments, a bottom part 211 constituted by a sole 212, which is perforated through from the tread toward the foot supporting region, and an upper part 213, which surrounds the foot and in turn comprises, from the inside outwardly, a lining 214, which surrounds the foot completely, a membrane 215 which is impermeable to water and permeable to water vapor, for example of the type known commercially as Gore-Tex® (optionally associated with a supporting mesh, according to a per se known structure), and an upper 216, made for example of leather, in any case of the vapor-permeable or perforated type, which surrounds the foot laterally.

The membrane 215 is associated with the lining 214 as an outer layer substantially along the entire pouch-like extension and therefore also along the part related to the sole of the foot.

The outer lower portion 217 of the top part 213 of the shoe 200, which is superimposed on the perforated area of the sole 212, is constituted by a portion 215*a* of the membrane 215.

In practice, the outer upper 216 surrounds laterally the lining 214 with the membrane 215 but does not cover it in its bottom part.

The lower flaps 218 of the outer upper 216 are arranged between the top part 213 and the sole 212, as described in greater detail hereinafter.

A protective element 222 for the membrane 215 is provided below the portion 215*a* of the membrane 215 and in direct contact therewith and is vapor-permeable (or equivalently perforated) and is made of a material that is impermeable to water and does not retain liquids; the protective element 222 is constituted for example by a net made of metal (for example made of stainless steel) or made of plastic material or of a synthetic resin based on propylene or polyethylene, or a synthetic fabric.

The lower flaps 218 of the upper 216, in this embodiment, do not have a reduced thickness.

For this reason, between the lower flaps 218 of the upper and the protective element 222 there is an annular element 230, which surrounds the protective element 222.

The annular element 230 is made of a material that is waterproof and does not retain liquids, such as for example a polymeric material such as EVA (ethyl vinyl acetate) or low-density PU (polyurethane), and it is useful, as mentioned, when the lower flaps 218 of the upper 216 have such dimensions as to not allow fixing of the sole 212 to the membrane 215 with an adequate seal, and therefore it has both sealing and filling functions.

The annular element 230 is adjacent to the edges of the lower flaps 218 of the upper 216.

The annular element 230 is sealed in an upward region to the membrane 215 and in a downward region to the sole 212, respectively by means of a second sealing area 221 and a third sealing area 223 (shown in dark lines).

In this embodiment, the water sealing region, designated by the reference sign 2A, is formed by the annular element 230 with the second sealing area 221 and the third sealing area 223.

In a manner similar to what has been described in the preceding embodiments, water can rise from the holes of the sole 212, pass through the protective element 222, and stop against the portion 215*a* of the waterproof and vapor-permeable membrane 215.

Here the water cannot stagnate, since the material of the insole does not allow it to, and it also cannot infiltrate toward the lower flaps 218 of the upper due to the presence of the sealing region 2A; the water therefore descends again, flowing in reverse with respect to the rising path.

Likewise, if the upper is wet laterally, the water can be absorbed up to the lower flaps 218 of the upper, but from there the moisture can easily evaporate by following the opposite path with respect to absorption.

As can be noted, in this embodiment the assembly insole is not provided.

Figure 5:
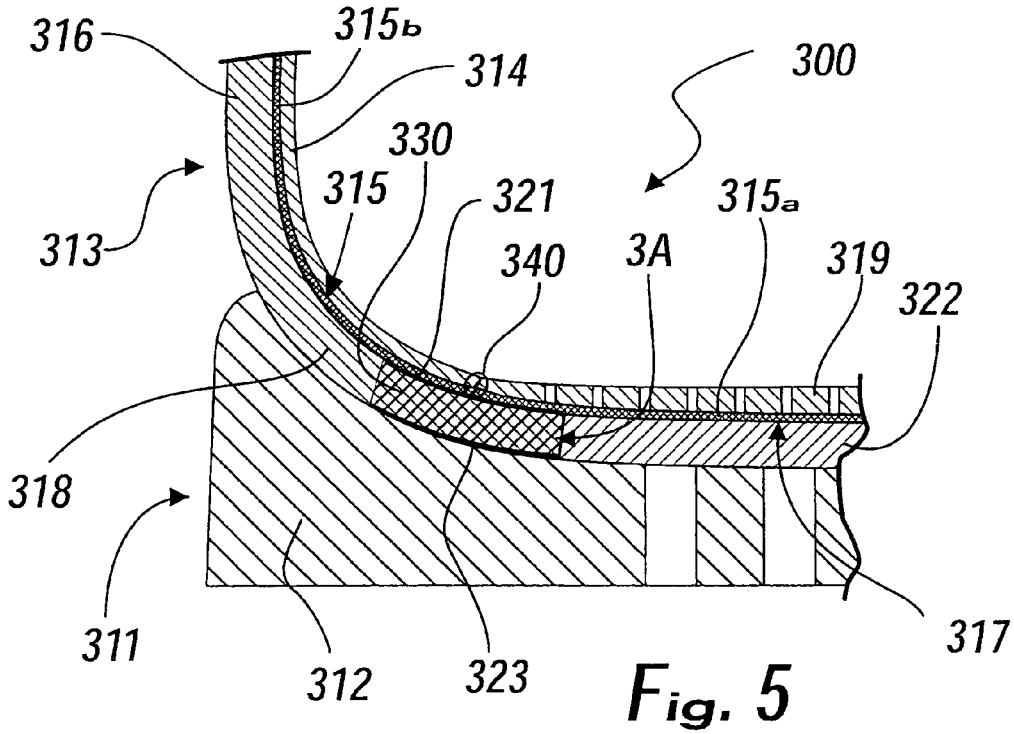
FIG. 5 is a schematic transverse sectional view of a portion of a shoe according to the invention, in a fourth embodiment with respect to the preceding figures.

A fourth embodiment of a shoe is shown in FIG. 5 and is generally designated by the reference numeral 300.

The shoe 300 comprises a bottom part 311, which is constituted by a sole 312, which is perforated through from the tread toward the foot supporting region, and a top part 313, which surrounds the foot and in turn comprises, from the inside outwardly, a lining 314, which wraps around the foot laterally and with which a membrane 315 is associated as an outer layer thereof, said membrane being waterproof and vapor-permeable and being constituted by an upper membrane part 315*b*, which together with the lining 314 surrounds the foot laterally, and by a membrane portion 315*a*, which is coupled in a downward region to a vapor-permeable or perforated strobel-stitch insole 319, which closes in a downward region said top part 313 of the shoe.

The strobel-stitch insole 319 with the membrane portion 315*a* are joined by a parametric stitched seam 340 (for example of the type known as strobel stitch) to the assembly formed by the lower flaps of the lining 314 and the upper membrane part 315*b*.

Below the membrane portion 315*a* there is a vapor-permeable or equivalently perforated protective element 322, which is made of a material that is waterproof and does not retain liquids and is constituted for example by a net made of metal (for example made of stainless steel) or made of plastic material or a synthetic resin based on propylene or polyethylene, or a synthetic fabric; preferably, the protective element 322 must not allow the stagnation of water.

The lower flaps 318 of the upper 316 do not have a reduced thickness in this embodiment.

For this reason, between the lower flaps 318 of the upper and the protective element 322 there is an annular element 330, which surrounds the protective element 322.

The annular element 330 is made of a material that is waterproof and does not retain liquids, such as for example a polymeric material such as EVA (ethyl vinyl acetate) or low-density PU (polyurethane), and is useful, as mentioned, when the lower flaps 318 of the upper 316 have such dimensions as to not allow to fix the sole 312 to the membrane 315 with an adequate seal, and therefore it has both sealing and filling functions.

In particular, the annular element 330 straddles the parametric stitched seam 340 and is sealed in an upward region to the membrane upper part 315*b* and to the membrane portion 315*a* and, in a downward region, to the sole 312, respectively by means of a second sealing area 321 and a third sealing area 323 (all shown in dark lines).

The annular element 330 is also designed to seal the region of the parametric stitched seam 340, in order to prevent the infiltration of water into the shoe.

In this embodiment, the water sealing region 3A is formed by the annular element 330 with the second sealing area 321 and the third sealing area 323.

Figure 6:
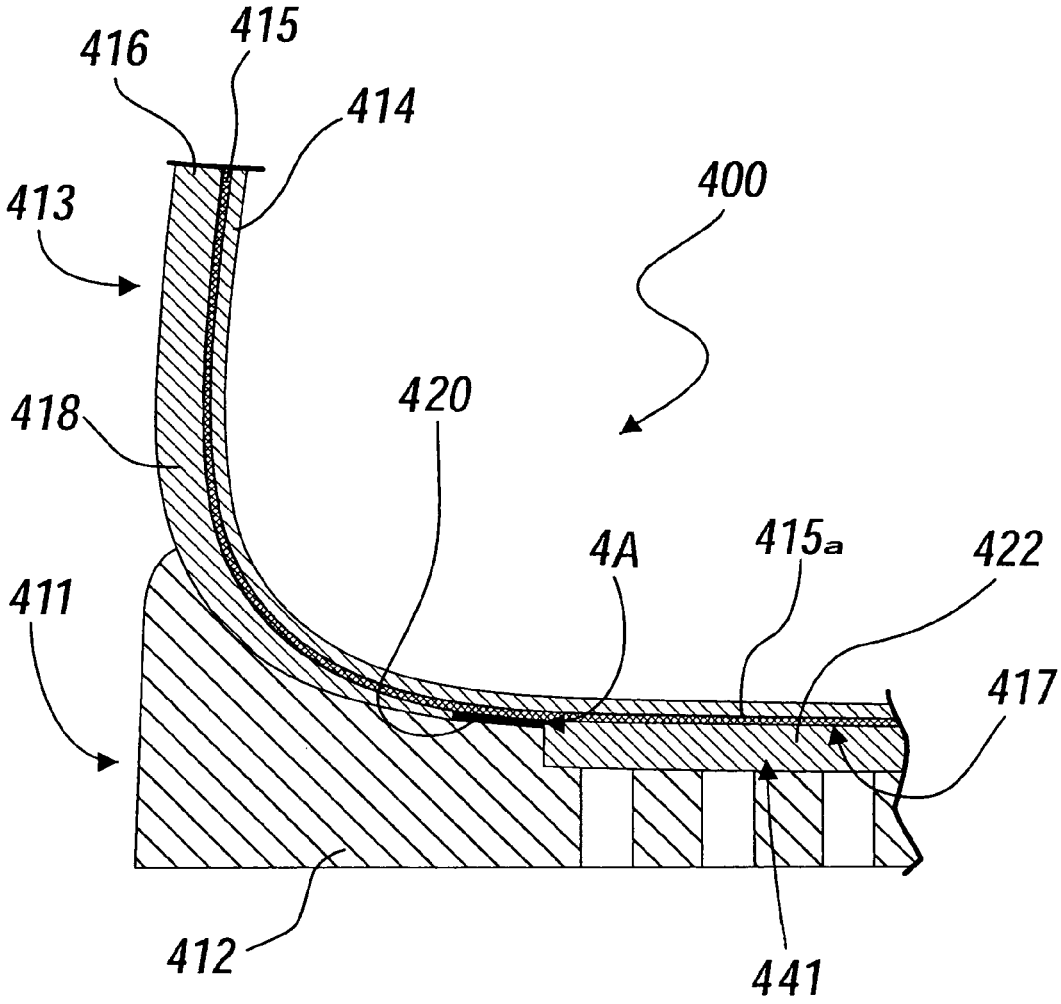
FIG. 6 is a schematic transverse sectional view of a portion of a shoe according to the invention, in a fifth embodiment with respect to the preceding figures.

A fifth embodiment of a shoe is shown in FIG. 6 and is generally designated by the reference numeral 400.

The shoe 400 comprises, as in the preceding embodiments, a bottom part 411, which is constituted by a sole 412, which is perforated through from the tread toward the foot supporting region, and a top part 413, which surrounds the foot and in turn comprises, from the inside outwardly, a lining 414, which surrounds the foot completely, a waterproof and vapor-permeable membrane 415, for example of the type known commercially as Gore-Tex® (optionally associated with a supporting mesh, according to a per se known structure), and an upper 416, made for example of leather, in any case of the vapor-permeable or perforated type, which surrounds the foot laterally.

The membrane 415 is associated with the lining 414 as an outer layer thereof substantially along the entire pouch-like extension and therefore also along the part related to the sole of the foot.

The outer lower portion 417 of the top part 413 of the shoe 400, which is superimposed on the perforated area of the sole 412, is constituted by a portion 415*a* of the membrane 415.

In practice, the outer upper 416 surrounds laterally the lining 414 with the membrane 415 but does not cover it in its lower part.

The lower flaps 418 of the outer upper 416 are arranged between the upper part 413 and the sole 412, as described in greater detail hereinafter.

A protective element 422 for the membrane 415 is provided below the portion 415*a* of the membrane 415 and in direct contact therewith and is vapor-permeable (or equivalently perforated) and is made of a material that is waterproof and does not retain liquids and is constituted for example by a net made of metal (for example made of stainless steel) or plastic material or a synthetic resin based on propylene or polyethylene, or a synthetic fabric; preferably, said protective element 422 must not allow the stagnation of water.

The lower flaps 418 of the upper 416 in this embodiment have a reduced thickness.

The protective element 422 for the membrane 415 is accommodated within a complementary cavity 441, which is open in the upper face of the sole 412.

Between the lower flaps 418 of the upper 416 and the protective element 422, perimetrically with respect to the perforated area of the sole 412, there is a sealing area 420 (designated in dark lines) for sealing said sole 412 with the membrane portion 415*a*.

The sealing area 420 forms the water sealing region 4A.

This shoe configuration is in practice the one that has the smallest number of components with respect to the different described embodiments.

Figure 7:
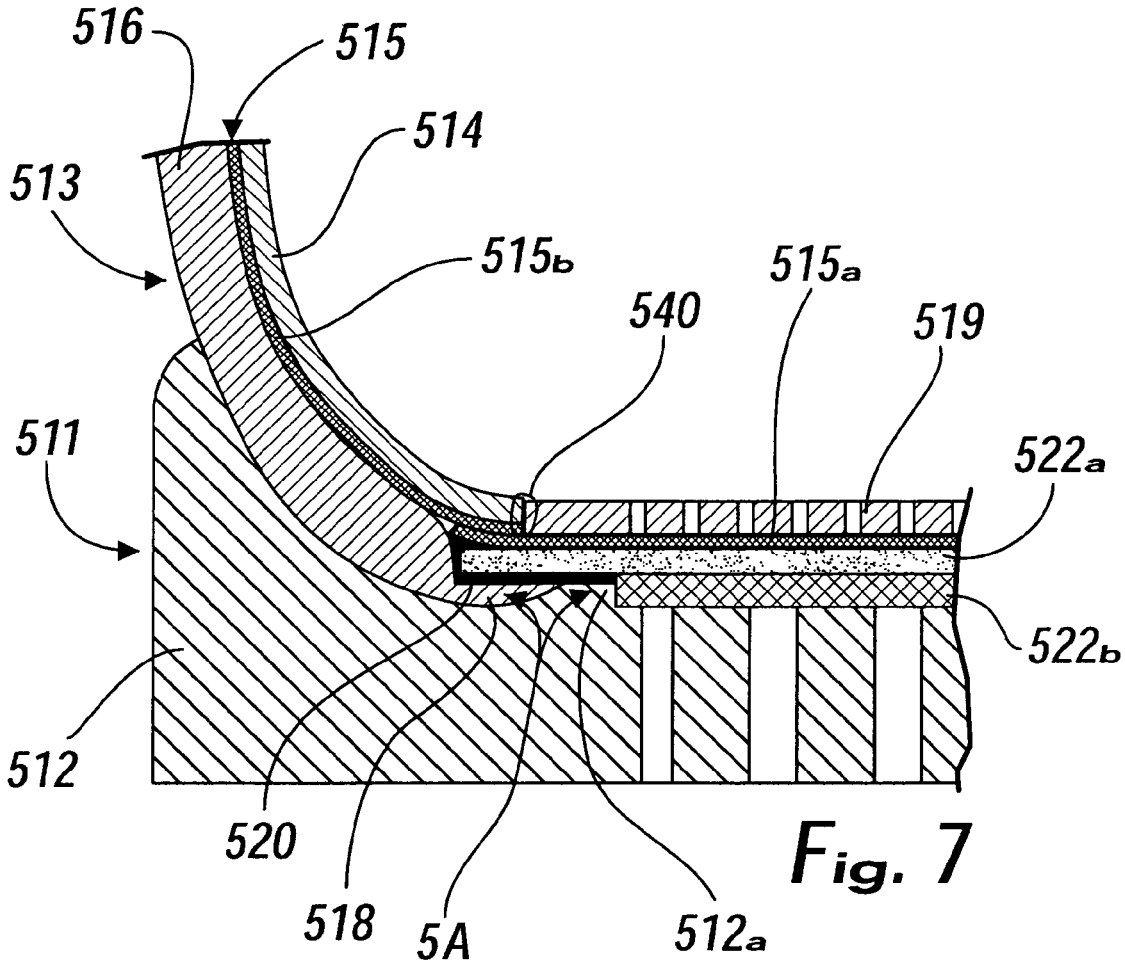
FIG. 7 is a schematic transverse sectional view of a portion of a shoe according to the invention, in a sixth embodiment with respect to the preceding figures.

FIG. 7 illustrates a sixth embodiment of a shoe according to the invention.

The shoe 500 comprises a bottom part 511, constituted by a sole 512, which is perforated through from the tread toward the foot supporting region, and a top part 513, which surrounds the foot and in turn comprises, from the inside outward, a lining 514, which surrounds laterally the foot and with which a waterproof and water vapor-permeable membrane 515 is associated as an outer layer thereof; said membrane is constituted by an upper membrane part 515*b*, which together with the lining 514 surrounds the foot laterally, and by a membrane portion 515*a* coupled in a downward region to a perforated (or equivalently vapor-permeable) insole 519, which closes in a downward region said top part 513 of the shoe; the top part 513 also comprises the upper 516, which is coupled externally to the membrane 515*b*.

The insole 519 is joined, at a connecting region, by a parametric stitched seam 540 (for example of the type known as strobel stitch), to the lower flaps of the lining 514 with the membrane upper part 515*b*.

Below the membrane portion 515*a*, directly in contact therewith, there is an intermediate vapor-permeable or equivalently perforated element, which is made of a material that is waterproof and/or does not retain liquids; for example, said intermediate element is constituted by a first protective element 522*a*, which is made for example of a water-repellent felt.

A second protective element 522*b* is provided between said first protective element 522*a* and the perforated region of the sole 512 and is constituted for example by a net which is made of metal (for example stainless steel) or plastic material or a synthetic resin based on propylene or polyethylene, or a synthetic fabric; preferably, said second protective element 522*b* must not allow the stagnation of water.

In particular, the first protective element 522*a* has substantially the same plan dimensions as the membrane portion 515*a*, which straddles the parametric stitched seam 540.

The second protective element 522*b* is smaller than the first protective element 522*a*.

The lower flaps 518 of the upper 516 are arranged below the first protective element 522*a*; in this embodiment, the part 512*a* of the sole is interposed between the lower flaps 518 and the second protective element 522*b*, making direct contact with the first protective element 522*a* (the sole 512 is, for example, overmolded on the upper part 513 of the shoe).

If the first protective element 522*a* is not waterproof but merely suitable to not retain liquids (such as for example a water-repellent felt), a water sealing area 520 is formed perimetrically with respect to the first protective element 522*a*; in particular, the sealing area 520 is provided on the peripheral parts of the lower face of the first protective element 522*a* and on the lateral edges of said element and of the membrane portion 515*a* until it abuts against the upper membrane part 515*b*.

In this embodiment, the water sealing region 5A is formed by the part 512*a* of the sole, interposed between the lower flaps 518 and the second protective element 522*b*, and by the sealing area 520.

In practice it has been found that the invention thus described achieves the intended aim and objects.

In particular, the present invention provides a waterproof and vapor-permeable shoe that ensures complete waterproofing both on the top part related to the upper and on the bottom part related to the sole.

This has been achieved thanks to a shoe which has a top shoe part, which in practice comprises a pouch made of a membrane that is vapor-permeable and waterproof which surrounds the foot also in the region of the sole of the foot, and is joined to a sole which is perforated for the passage of water vapor from the inside to the outside of the shoe.

Such shoe provides for the fact that any vapor-permeable or perforated layers interposed between the perforated region of the sole and the part of the membrane related to the region of the sole of the foot are made of a material that does not retain liquids and/or is waterproof.

It is essential that the (vapor-permeable or perforated) layer in direct contact with the membrane be made of a material that does not retain liquids and/or is waterproof: this layer can be an assembly insole, a protective element or also a structural filler layer.

In this manner, in contact with the membrane in the outer lower portion of the top part of the shoe there is no material that retains humidity, thus avoiding unpleasant effects of humidity and formation of microbacteria which can produce bad odors or a degradation of the shoe.

It is also essential that there be no stagnation of water between the perforated region of the sole and the flaps of the upper; this is why a water sealing region has been provided which joins, perimetrically with respect to the perforated area of the shoe, the sole and the membrane, thus preventing stagnation in that region and preventing the passage of water from the flaps of the upper to the perforated region of the sole and vice versa.

The invention thus conceived is susceptible of numerous modifications and variations, all of which are within the scope of the appended claims; all the details may further be replaced with other technically equivalent elements.

In practice, the materials used, so long as they are compatible with the specific use, as well as the dimensions, may be any according to the requirements and to the state of the art.

The disclosures in Italian Patent Application No. PD2005A000228 from which this application claims priority are incorporated herein by reference.

The invention claimed is:

1. A waterproof and vapor-permeable shoe, comprising:

a bottom shoe part, which comprises a sole that is perforated through from a tread toward a foot resting region;

a top shoe part, which surrounds a foot completely and in turn comprises, from inside outwardly:

a vapor-permeable or perforated lining;

a membrane, which is waterproof and vapor-permeable and surrounds the foot completely;

a vapor-permeable or perforated upper;

an outer bottom portion of said top shoe part, which is superimposed on a perforated area of said sole, being constituted by a portion of said membrane, a vapor-permeable or perforated protective element for said portion of the membrane being provided below said portion of the membrane and above the tread of said sole, material arranged below said portion of the membrane and in direct contact therewith being waterproof and/or not retaining liquids, a water sealing region being provided between said portion of the membrane and said sole, around the perforated area of said sole, and separating flaps of said upper from the perforated area of said sole.

2. The shoe of claim 1, wherein said lining is pouch-shaped and said membrane is associated with said lining as an outer layer thereof substantially along an entire pouch-like extension, an assembly insole being provided below said portion of the membrane and in direct contact therewith, said insole being vapor-permeable or perforated and being made of a material that is waterproof and does not retain liquids, and being sealed perimetrically on said membrane by a first sealing area, lower flaps of said upper being superimposed on a perimetric portion of said assembly insole, said protective element being provided below said assembly insole, at the perforated area of said sole, a second area for sealing said sole to the perimetric portion of said assembly insole that is free from the flaps of the upper being provided between said lower flaps of the upper and said protective element, said first sealing area, together with said second sealing area and the perimetric portion of the insole arranged between them, forming said water sealing region.

3. The shoe of claim 1, wherein said lining is pouch-shaped and said waterproof and vapor-permeable membrane is associated with said lining as an outer layer thereof substantially along an entire pouch-like extension, an assembly insole being provided below said portion of the membrane and in direct contact therewith, said assembly insole being vapor-permeable or perforated and being made of a material that is waterproof and does not retain liquids and being sealed perimetrically on said membrane by a first sealing area, the flaps of said upper being superimposed on a perimetric portion of said assembly insole, below said assembly insole there being, at the perforated area of said sole, said protective element, between lower flaps of the upper and said protective element there being an annular element, which surrounds said perforated area of said sole, said annular element being sealed in an upward region with respect to said insole and in a downward region with respect to said sole respectively by a second sealing area and a third sealing area, said annular element further being made of a material that is waterproof and does not retain liquids, said water sealing region being formed by said first sealing area together with said second sealing area and the perimetric portion of the insole arranged between them, and by said annular element with said third sealing area.

4. The shoe of claim 1, wherein said lining is pouch-shaped and said waterproof and vapor-permeable membrane is associated with said lining as an outer layer thereof substantially along its entire pouch-shaped extension, said protective element for said membrane being provided below said portion of the membrane and in direct contact therewith, an annular element being provided between said membrane and said sole, perimetrically with respect to said protective element, said annular element being adjacent to said flaps of the upper and being made of a material that is waterproof and does not retain liquids, said annular element being sealed in an upward region with respect to said membrane and in a downward region with respect to said sole respectively by a second sealing area and a third sealing area, said water sealing region being formed by said annular element with said second sealing area and said third sealing area.

5. The shoe of claim 1, wherein said waterproof and vapor-permeable membrane is constituted by an upper membrane part, which, together with said lining, surrounds the foot laterally, and by a membrane portion which is coupled in a downward region to a strobel-stitch insole, which is vapor-permeable or perforated and closes in a downward region said top part of the shoe, said strobel-stitch insole with said membrane portion being joined by a perimetric stitched seam to lower flaps of said lining with the upper membrane part, said protective element being arranged below said membrane portion and directly in contact therewith, an annular element being provided below said perimetric stitched seam, said annular element being adjacent to said lower flaps of the upper and being made of a material that is waterproof and does not retain liquids, said annular element being sealed in an upward region with respect to an upper part of the membrane and said membrane portion and in a downward region with respect to said sole, respectively by a second sealing area and a third sealing area, said water sealing region being formed by said annular element, with said second sealing area and said third sealing area.

6. The shoe of claim 1, wherein said lining is pouch-shaped and said waterproof and water vapor-permeable membrane is associated with said lining as an outer layer thereof substantially along an entire pouch-shaped extension, below said portion of the membrane and in direct contact therewith there being said protective element for said membrane, between said flaps of the upper and said protective element, perimetrically with respect to the perforated area of said sole, there being an area for sealing said sole to said membrane, said sealing area forming said water sealing region.

7. The shoe of claim 1, wherein said waterproof and water vapor-permeable membrane is constituted by an upper membrane part, which, together with said lining, surrounds the foot laterally, and by a membrane portion which is coupled in a downward region to a vapor-permeable or perforated insole, which closes in a downward region said top part of the shoe, said insole being joined to flaps of said lining with said upper membrane part, in a downward region and directly in contact with said membrane portion there being a vapor-permeable or perforated intermediate element made of a material that is impermeable to water and/or does not retain liquids, a second protective element being provided between said first protective element and the perforated region of said sole, said membrane portion straddling the region connecting said insole to lower flaps of said lining and said upper membrane part.

8. The shoe of claim 7, wherein said protective element substantially has same plan dimensions as said membrane portion, while said second protective element is smaller than said protective element, said water sealing region being formed by the part of the sole interposed between the flaps of said upper and said second protective element, and by the sealing area provided on the peripheral parts of the lower face of said protective element and on the lateral edges thereof and of said membrane portion, until abutment occurs against said upper membrane part.

9. The shoe of claim 8, wherein said second protective element has a net-like structure.

10. The shoe of claim 1, comprising additional layers arranged between said membrane and said sole that are vapor-permeable or perforated and made of a material that is waterproof and does not retain liquids.

11. The shoe of claim 1, wherein said membrane is associated with a supporting mesh.

* * * * *